US006514106B2

(12) United States Patent
Peck

(10) Patent No.: US 6,514,106 B2
(45) Date of Patent: Feb. 4, 2003

(54) POSITIVE LOCKING ELEMENT LEAD RETAINER/INSULATOR

(75) Inventor: Kevin B. Peck, Sonora, CA (US)

(73) Assignee: MRL Industries, Sonora, CA (US)

( * ) Notice: Subject to any disclaimer, the term of this patent is extended or adjusted under 35 U.S.C. 154(b) by 0 days.

(21) Appl. No.: 09/879,152

(22) Filed: Jun. 13, 2001

(65) Prior Publication Data

US 2002/0192995 A1 Dec. 19, 2002

(51) Int. Cl.[7] ..... H01R 13/415
(52) U.S. Cl. ..... 439/742; 439/347; 439/908
(58) Field of Search ..... 439/347, 359, 439/733.1, 742, 908; 174/50.53, 58, 59; 373/101

(56) References Cited

U.S. PATENT DOCUMENTS

| | | | | |
|---|---|---|---|---|
| 4,120,555 A | * | 10/1978 | Shiflett et al. | 439/550 |
| 4,596,922 A | | 6/1986 | Erickson | 219/390 |
| 5,423,692 A | * | 6/1995 | Francis | 439/335 |
| 5,639,268 A | * | 6/1997 | Julian et al. | 439/737 |
| 6,100,470 A | * | 8/2000 | Gretz | 174/59 |
| 6,125,134 A | | 9/2000 | Jönsson et al. | 373/128 |
| 6,377,604 B1 | * | 4/2002 | Rodriguez | 373/94 |

* cited by examiner

*Primary Examiner*—Lynn D. Feild
*Assistant Examiner*—Michael C. Zarroli
(74) *Attorney, Agent, or Firm*—Burns, Doane, Swecker & Mathis, LLP

(57) ABSTRACT

An improved collar, interlocking arrangement, an electric furnace are provided. The improved arrangement includes an electrically insulating collar having a mounting flange and a passageway, an electrically conductive lead disposed at least partially within the passageway, and means for securing the lead relative to the passageway such that the lead is maintained in its proper position. An improved electric furnace includes an interior portion, thermal insulation disposed within the interior portion, at least one heating element disposed, an electrical lead having a first terminal portion disposed within the interior portion and a second terminal portion disposed outside the interior portion, an electrical connector electrically connected to the at least one heating element and disposed on the first terminal portion, an exterior wall, an electrically insulating collar, the lead being at least partially received within the collar, and the lead being secured relative to the collar such that the lead is maintained in its proper position.

22 Claims, 2 Drawing Sheets

POSITIVE LOCKING ELEMENT LEAD RETAINER/INSULATOR

FIELD OF THE INVENTION

The present invention relates to improved collar constructions. More particularly, the present invention relates to an improved arrangement for positively locking and locating an electrical lead.

BACKGROUND OF THE INVENTION

In the description of the background of the present invention that follows reference is made to certain structures and methods, however, such references should not necessarily be construed as an admission that these structures and methods qualify as prior art under the applicable statutory provisions. Applicants reserve the right to demonstrate that any of the referenced subject matter does not constitute prior art with regard to the present invention.

It is common in many types of electrical devices to have an electrical lead which provides an electrical connection between components of the device and a power supply.

FIG. 1 is illustrative of such a device. The device of FIG. 1 will now be described for purposes of illustration.

FIG. 1 illustrates an electric furnace 1. Such furnaces are used, for example, in the semiconductor industry to heat semiconductor wafers. The electric furnace 1 includes an interior portion 3 which receives the articles to be heated (not shown). The interior portion is provided with thermal insulation 5, which is typically formed of a refractory material such as a ceramic fiber.

One or more heating elements 7 are also disposed in the interior portion 3. The heating element(s) 7 are commonly embedded in the thermal insulation 5.

Such furnace constructions are described in more detail in U.S. Pat. Nos. 4,596,922 and 6,125,134, both of which are incorporated herein by reference, in their entirety.

One or more electrical leads 9, 9' are also at least partially disposed within the interior portion 3. An arrangement associated with one of these leads will now be described. The lead 9 can be at least partially embedded within the thermal insulation. The lead 9 generally comprises a first terminal portion 11 and a second terminal portion 13. One or more heating elements 7 are electrically coupled to the first terminal portion 11 via an electrical connector 15, and possibly through one or more internal bussing devices (not shown). The second terminal portion 13 of the lead 9 is electrically connected to power source (not shown).

The lead 9 passes through an electrically insulating collar 17, the collar 17 being attached to an exterior wall 18 of the furnace 1. Since both the lead 9 and the exterior wall 18 of the furnace are electrically conductive, the insulating collar 17 serves to prevent short circuiting by preventing contact between the lead 9 and the exterior wall 18 as the lead passes therethrough. The lead 9 is freely passed through the collar 17, in the sense that there is no mechanism which positively secures the lead 9 relative to the collar 17. The lead 9 is embedded in the thermal insulation 5, and in the illustrated device, the insulation 5 is in turn being compressed against the interior of the wall 18 of the furnace.

The above-described arrangement can be repeated about the circumference of the furnace 1, as indicated by reference numeral 9'.

The above-described arrangement can possess certain disadvantages.

As noted above, during construction of the furnace 1, the insulation 5 is compressed between at least the first terminal portion 11 of lead 9 and the interior surface of wall 18 of the furnace 1. This compressed insulation can produce an inward force on the first terminal portion 11, thereby causing the lead 9 to "settle" into the interior of the furnace.

The interior portion of the furnace is subjected to thermal cycling during the useful lifetime of the device. The different rates of thermal expansion of the interior components of the furnace, degradation of the insulating materials, etc. can all contribute to the above-mentioned settling effect.

Shocks, stresses, and/or forces applied to the portion of the lead 9 which extends beyond the exterior wall 18 and the collar 17, for instance at the second terminal portion 13, are transferred to the interior of the furnace 1 since the lead 9 is freely moveable relative to the collar 17. Thus, such externally applied shocks, stresses and/or forces represent another source of potential damage to the interior of the furnace 1.

There exists a need in the art for improved collar constructions, for improved arrangements for positively locking and locating an electrical leads, and for improved electric furnace constructions that more effectively prevent damage to the internal construction of such furnaces.

SUMMARY OF THE INVENTION

The present invention addresses the above-mentioned problems of the prior art, and others.

The present invention provides a collar and a locking element for positively locating the a lead passing therethrough and maintaining the lead in its proper position.

According to one aspect, the present invention provides an arrangement comprising an electrically insulating collar, the collar comprising: a mounting flange and a passageway; an electrically conductive lead disposed at least partially within the passageway; and means for securing the lead relative to the passageway such that the lead is maintained in its proper position.

According to another aspect, the present invention provides an electric furnace comprising: an interior portion; thermal insulation disposed within the interior portion; at least one heating element disposed within the interior portion; an electrical lead having a first terminal portion disposed within the interior portion and a second terminal portion disposed outside the interior portion; an electrical connector electrically connected to the at least one heating element and disposed on the first terminal portion; an exterior wall; an electrically insulating collar, the lead at least partially received within the collar; and means for securing the lead relative to the collar such that the lead is maintained in its proper position.

According to a further aspect, the present invention provides an arrangement for positively securing an electrical lead of an electric furnace, the lead passing from within the furnace to outside the furnace, the arrangement comprising an exterior furnace wall; an electrically insulating collar, the collar comprising a mounting flange attached to the exterior wall, and a passageway; an electrically conductive lead disposed at least partially within the passageway; and a fastener securing the lead relative to the passageway such that the lead is maintained in its proper position.

BRIEF DESCRIPTION OF THE DRAWING FIGURES

DETAILED DESCRIPTION OF THE INVENTION

Preferred embodiments of an improved arrangement and collar are illustrated in FIGS. 2–5. The improved arrangement and collar of the present invention is especially suited for use in conjunction with an electric furnace of the type illustrated in FIG. 1. However, it is to be understood that the improved arrangement and collar of the present invention can also be used in conjunction with other numerous devices and in a number of different environments.

Figure 2:
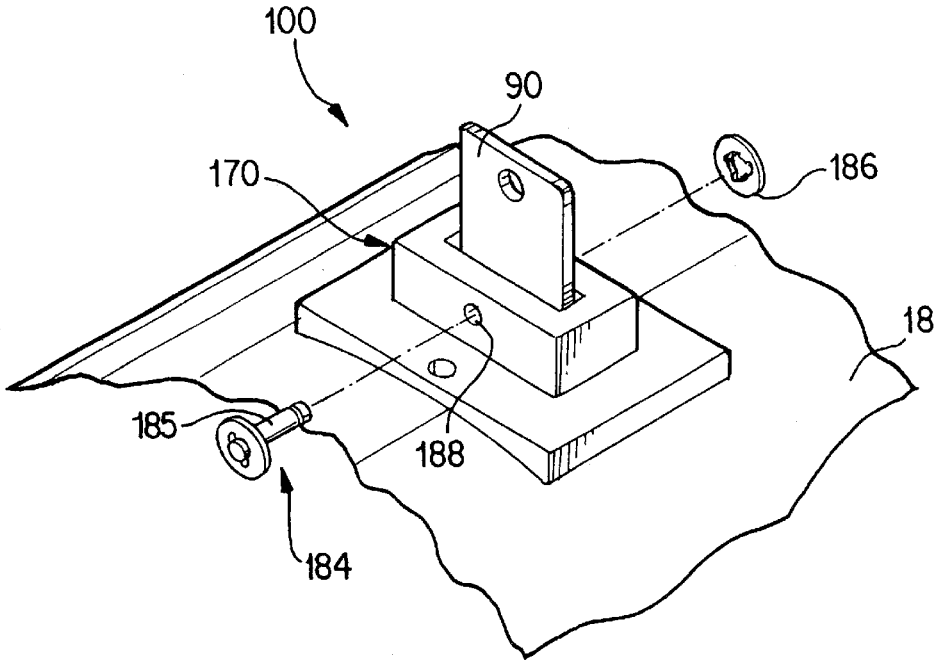
FIG. 2 is a partial perspective view of an improved arrangement formed according to the present invention.
Figure 3:
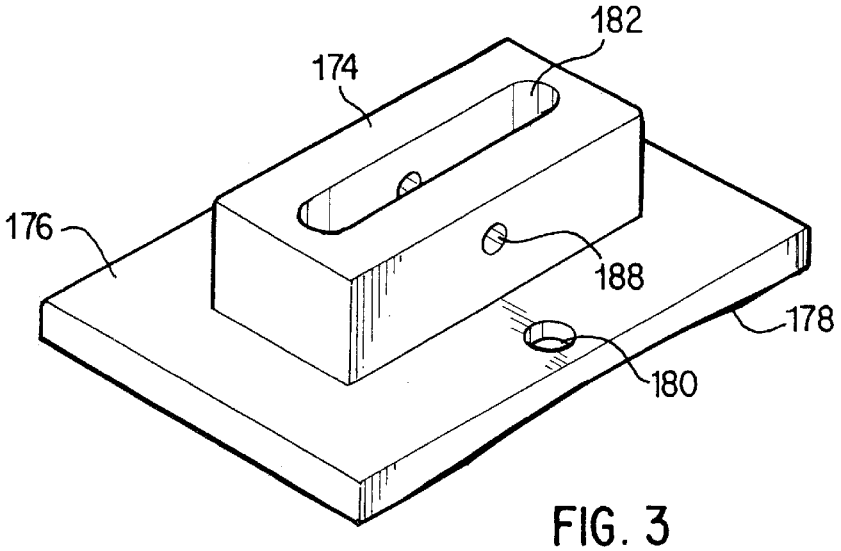
FIG. 3 is a perspective view of an improved collar formed according to the principles of the present invention.
Figure 4:
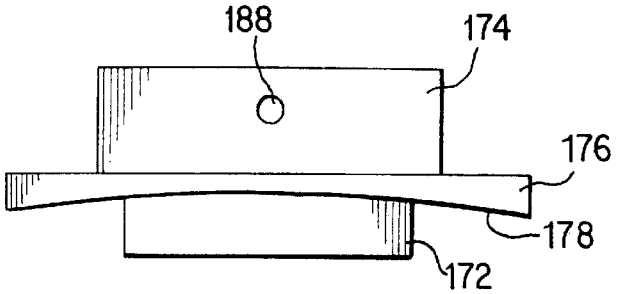
FIG. 4 is a side view of the collar of FIG. 3.
Figure 5:
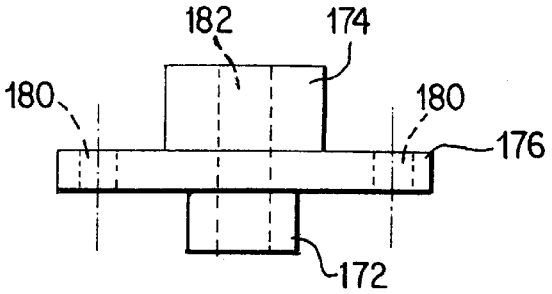
FIG. 5 is also a side view from the collar of FIG. 3 but at a different angle of rotation.

FIG. 2 illustrates an improved arrangement 100 formed according to the principles of the present invention.

Figure 1:
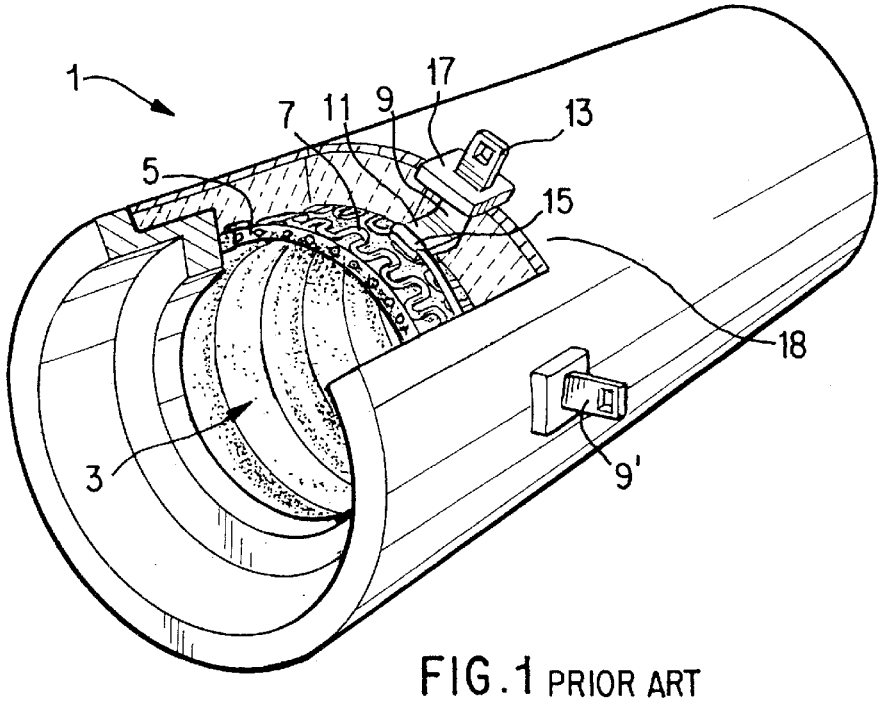
FIG. 1 PRIOR ART
FIG. 1 is a partial cutaway perspective view of a conventional electric furnace construction.

The improved arrangement 100 includes an electrical lead 90. The lead 90 is formed of any suitable electrically conductive material. According to a preferred embodiment, the lead 90 has a construction which is similar to that of lead 9 described above in connection with the electric furnace of FIG. 1. In this regard, the lead 90 can have a first terminal portion as well as a second terminal portion. The first terminal portion thereof preferably located within the associated device, and the second terminal portion preferably being located outside the associated device. As illustrated in FIG. 1, the lead 90 can have a L-shaped geometry. However, the lead 90 can be formed with any suitable shape or geometry.

The arrangement 100 further includes a collar 170. According to a preferred embodiment, the collar 170 is formed from an electrically insulating material. The electrically insulating material can comprise a refractory material, such as a ceramic. Details of a collar 170 formed according to a preferred embodiment of the present invention are illustrated in FIGS. 2–5.

According to the illustrated embodiment, the collar 170 includes a first rim 172 and a second rim 174 projecting in opposite directions from a mounting flange 176. Mounting flange 176 is preferably provided with a conforming surface 178 which is shaped to conform to an external surface upon which it is adapted to be mounted, such as a cylindrical external wall 18 of an electric furnace 1. The mounting flange 176 is also preferably provided with through holes 180 which are adapted to receive fasteners or other securing elements which are intended to secure the collar 170 to the device to which it is intended to be associated.

According to the illustrated embodiment, the collar 170 is further provided with a lead accepting passageway 182 which is disposed through the first rim 172, the mounting flange 176, as well as the second rim 174. The passageway 182 is provided with a geometry and dimensions which are adapted to at least partially receive an appropriate electrical lead, e.g. –90.

According to the illustrated embodiment, the electrical lead 90 extends through the entire length of passageway 182, and in fact extends beyond the opposing ends of passageway 182. However, it is within the scope of the present invention that the electrical lead 90 be associated with the passageway 182 in a number of different alternative manners. For example, the lead 90 could be provided with a length which corresponds to the length of passageway 182 such that the lead 90 would extend throughout the entire length of the passageway 182, but not beyond the ends of the passageway 182. Alternatively, the electrical lead 90 may extend only partially along the extent of the passageway 182. For example, the electrical lead 90 could extend into one end of the passageway 182, but terminate at a location which is within the passageway 182.

The arrangement 100 is further provided with a means for securing the lead 90 relative to the passageway 182 of the collar 170, such that the lead 90 is maintained in its predetermined proper position. According to the illustrated embodiment, the means for securing comprises an appropriate fastener 184, such as a fillister-type element comprising a pin or shaft 185 and securing end members 186. However, it is within the scope of the present invention that alternative fasteners and similar devices could be utilized to secure the lead 90 relative to the passageway 182. Moreover, numerous equivalents to the above-mentioned fastener 184 are contemplated. Namely, the means for securing preferably comprises any suitable mechanical interlocking construction. For example, it is within the scope of the present invention that the electrical lead 90 and the collar 170 could be provided with one or integrally formed interlocking projection(s) and recess(es) which interlock to form the desired securing function when the electrical lead 90 is inserted through the passageway 182. It is also envisioned that other non-mechanical interlocking arrangements could be utilized. For instance, a magnetic interlocking arrangement could be provided by providing magnets having opposite polarities on the electrical lead 90 and the collar 170 which possess a magnetic field strong enough to securely retain the electrical lead 90 in its proper position relative to the passageway 182.

In the illustrated embodiment, the fastener 184 is received into a through hole 188 formed in the second rim 174. The fastener 184 also passes through the electrical lead 90 (not shown), and exits through an opposing side of the second rim 174, thereby positively locking the electrical lead 90 in its desired proper position relative to the passageway 182. It is, of course, possible to provide the fastener 184 at various locations on the collar 170 and still provide the desired securing of the lead 90 relative to the passageway 182.

As previously noted, the improved arrangement 100 can be provided in association or in combination with an electric furnace, similar to the type illustrated in FIG. 1. In this regard, the portion of the electrical lead extending into the furnace 1 can be provided with a construction which is similar to, or even identical to that of the lead 9 illustrated in FIG. 1. Moreover, a plurality of improved arrangements 100 can be utilized together in a single device, as also illustrated in FIG. 1.

Thus, according to the present invention, an improved arrangement has been provided which securely bidirectionally locks an electrical lead member in its proper position with respect to an associated collar member. By "bidirectionally", it is intended to mean that the lead in the directions leading into as well as out of the furnace, from the perspective of drawing FIGS. 1 and 2. It is also within the scope of the present invention to lock the lead against movement in additional directions as well. Such an arrangement provides certain benefits not attainable by similar conventional arrangements. For instance, in the example of an electric furnace, the improved arrangement of the present invention acts to impede the above-described settling of the lead 90. Also, the weight of the electrical connectors and wiring which is attached to the lead 90 is more positively supported. Moreover, various shocks, stresses, and/or forces which may be externally applied to the electrical lead element are not transferred to the interior components of the furnace. The improved arrangement according to the principles of the present invention acts to prevent damage to such internal components of an electric furnace.

While the present invention has been described by reference to the above-mentioned embodiments, certain modifications and variations will be evident to those of ordinary skill in the art. Therefore, the present invention is to limited only by the scope and spirit of the appended claims.

What is claimed is:

1. An arrangement comprising:

an electrically insulating collar, the collar comprising a mounting flange, a passageway, a first rim projecting in a first direction from the mounting flange, and a second rim projecting from the mounting flange in a second direction, and wherein the mounting flange is securable to an exterior wall;

an electrically conductive lead disposed at least partially within the passageway; and means for securing the lead relative to the passageway such that the lead is maintained in its proper position.

2. The arrangement of claim 1, in combination with the exterior wall, the mounting flange being secured to the exterior wall.

3. The arrangement of claim 2, wherein the exterior wall comprises the exterior wall of an electric furnace.

4. The arrangement of claim 3, wherein the lead comprises a first terminal portion and a second terminal portion extending beyond the exterior wall and beyond the insulating collar.

5. The arrangement of claim 1, wherein the means for securing comprises a fastener.

6. The arrangement of claim 5, wherein the fastener passes through both the first rim and the lead.

7. The arrangement of claim 4, wherein the arrangement further comprises an electrical connector disposed on the first terminal portion.

8. The arrangement of claim 3, further comprising:

thermal insulation disposed within an interior portion of the electric furnace;

at least one heating element disposed within the interior portion of the electric furnace;

the lead further comprising a first terminal portion disposed within the interior portion of the electric furnace; and an electrical connector disposed on the first terminal portion thereby electrically connecting the lead with the at least one heating element.

9. The arrangement of claim 1, wherein the mounting flange has a conforming surface which is shaped to conform to an external surface upon which it is adapted to be mounted.

10. The arrangement of claim 1, wherein the electrically insulating collar including the first rim, the second rim and the mounting flange are formed as one piece.

11. The arrangement of claim 2, wherein the mounting flange is secured to an outside surface of the exterior wall.

12. An electric furnace comprising:

an interior portion;

thermal insulation disposed within the interior portion;

at least one heating element disposed within the interior portion;

an electrical lead having a first terminal portion disposed within the interior portion and a second terminal portion disposed outside the interior portion;

an electrical connector electrically connected to the at least one heating element and disposed on the first terminal portion;

an exterior wall;

an electrically insulating collar, the collar having a mounting flange attached to the exterior wall, a first rim projecting in a first direction from the mounting flange, and a second rim projecting in a second direction from the mounting flange, the lead at least partially received within the collar; and means for securing the lead relative to the collar such that the lead is maintained in its proper position.

13. The furnace of claim 12, wherein the means for securing comprises a fastener.

14. The furnace of claim 13, wherein the fastener passes through both the first rim and the lead.

15. The arrangement of claim 12, wherein the mounting flange has a conforming surface which is shaped to conform to an external surface of the exterior wall.

16. The arrangement of claim 12, wherein the electrically insulating collar, including the first rim, the second rim and the mounting flange, are formed as one piece.

17. An arrangement for positively securing an electrical lead of an electric furnace, the lead passing from within the furnace to outside the furnace, the arrangement comprising:

an exterior furnace wall;

an electrically insulating collar, the collar comprising a mounting flange attached to the exterior wall, a passageway, a first rim projecting in a first direction from the mounting flange, and a second rim projecting from the mounting flange in a second direction;

an electrically conductive lead disposed at least partially within the passageway; and a fastener securing the lead relative to the passageway such that the lead is maintained in its proper position.

18. The arrangement of claim 17 wherein the fastener passes through the first rim and the lead.

19. The arrangement of claim 17, wherein the lead comprises a first terminal portion and a second terminal portion extending beyond the exterior wall of the furnace and beyond the insulating collar.

20. The arrangement of claim 19, further comprising an electrical connector disposed on the first terminal portion.

21. The arrangement of claim 17, wherein the mounting flange has a conforming surface which is shaped to conform to an external surface of the exterior furnace wall.

22. The arrangement of claim 17, wherein the electrically insulating collar including the first rim, the second rim and the mounting flange are formed as one piece.

* * * * *